US005865209A

United States Patent [19]

Vidal

[11] Patent Number: 5,865,209

[45] Date of Patent: Feb. 2, 1999

[54] AIR GAP ADAPTER

[75] Inventor: Jose Freddy Vidal, North Hollywood, Calif.

[73] Assignee: QMP, Inc., Sun Valley, Calif.

[21] Appl. No.: 666,606

[22] Filed: Jun. 18, 1996

[51] Int. Cl.[6] ..... E03C 1/10

[52] U.S. Cl. ..... 137/216; 285/330; 138/37; 138/89; 138/109; 138/120; 210/418; 210/436; 210/437; 210/438; 210/441; 210/450; 210/460

[58] Field of Search ..... 210/418, 436, 210/437, 438, 441, 450, 460, 433.1; 137/216; 285/330; 138/37, 89, 109, 120

[56] References Cited

U.S. PATENT DOCUMENTS

| | | | |
|---|---|---|---|
| 3,794,172 | 2/1974 | Bray | 210/433.1 |
| 3,967,638 | 7/1976 | Tondreau | 137/216 |
| 4,134,419 | 1/1979 | Richetti | 137/216 |
| 4,210,533 | 7/1980 | Astl | 210/418 |
| 4,853,117 | 8/1989 | Burrows | 210/257.2 |
| 5,635,058 | 6/1997 | Bowman | 210/460 |

*Primary Examiner*—W. L. Walker
*Attorney, Agent, or Firm*—Daniel R. Kimbell

[57] ABSTRACT

An air gap adapter for use with a water faucet. The air gap adapter has an adapter body with a base portion and an integral riser portion which extends generally vertically upwardly from a rear region of the base portion. The base portion has a hole for a water inlet shank of the water faucet, and the riser portion has brine inlet and outlet bores. The brine outlet bore is vertically oriented in the riser portion, and the brine inlet and outlet bores are open at their upper region. Two barbed connectors are located at a lower region of the adapter body and provide a brine inlet and outlet to the adapter. A venting aperture is formed near an upper region of said riser portion and passes into the brine outlet bore. A cap is positioned on the riser portion above the bores. A brine focusing ring with focusing hole is located in the brine outlet bore above the venting aperture and focuses the flow of brine downwardly into the brine outlet bore so that the brine does not contact the inside side walls of the brine outlet bore. In use, the water faucet will be placed with its water inlet shank through said aperture in said base portion of said adapter body so that the valve body rest on said base portion and lies in front of and adjacent said riser portion.

10 Claims, 3 Drawing Sheets

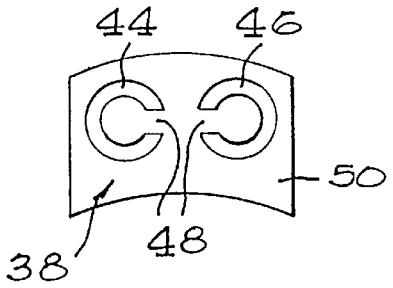
FIG. 5
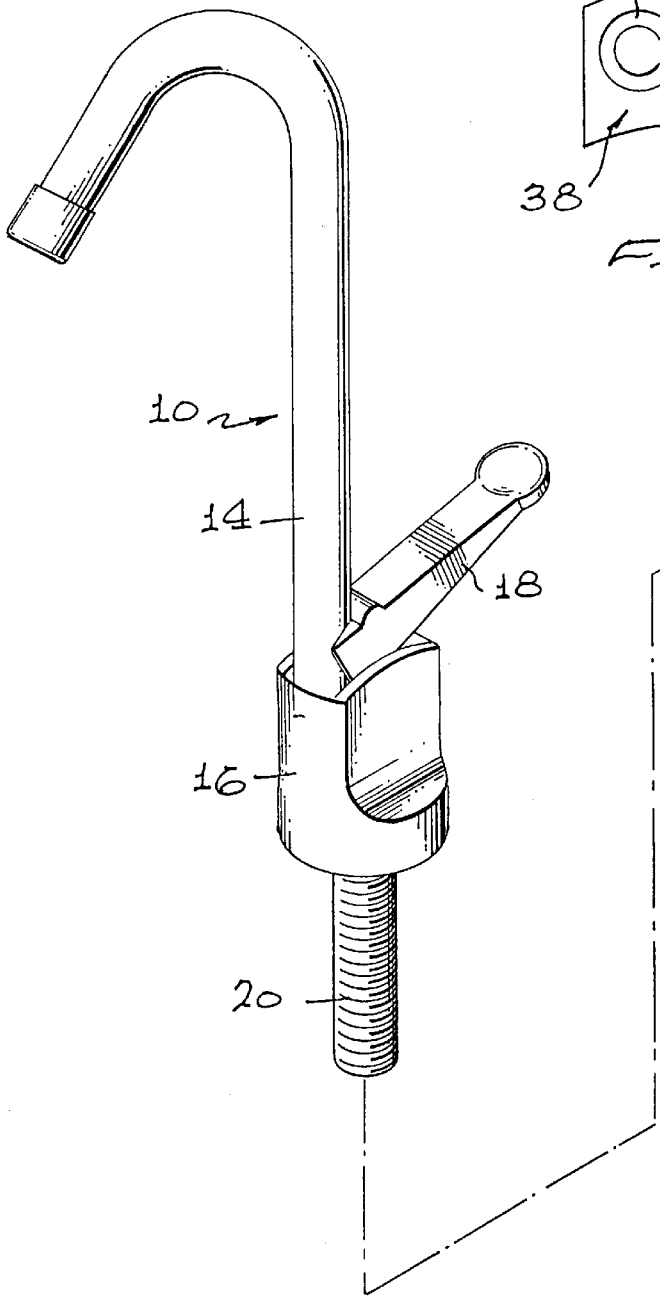
FIG. 2
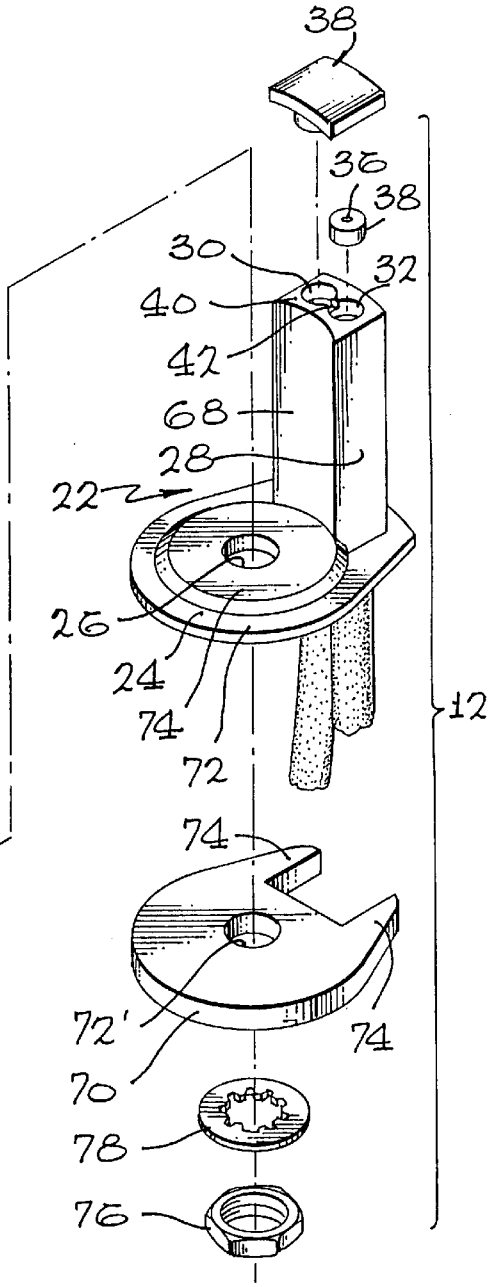

AIR GAP ADAPTER

BACKGROUND OF THE INVENTION

1. Field of the Invention

This invention relates to plumbing components, and more particularly to an air gap adapted to be used in conjunction with devices which require an air gap, such as reverse osmosis water purification units.

2. Description of the Prior Art

As concern about the quality of our nations' drinking water grows, increasing numbers of individuals are purchasing drinking water in bottles, or treating their tap water themselves. These treatment methods vary from simply filtering the tap water through fibrous filters to remove rust and sediment, to more costly carbon filters, which traps many organic molecules, heavy metals, and many microorganisms. After filtering, the cleaner water is routed to a clean water outlet. One cost effective means to create a very high quality of purified water is the use of reverse osmosis drinking water systems, which typically include a fibrous prefilter, a carbon filter, and lastly utilizes the effect of reverse osmosis to force pure water through a membrane and into a holding tank. The reverse osmosis method of water purification, as one of its sides effects, generates a considerably high percentage of waste water, or brine, as it is commonly referred to, which is shunted to a drain line. By law, this brine must be passed though an air gap before it is drained into a drain line to provide an anti-siphon break.

Several companies offer reverse osmosis faucets which directly incorporate air gaps into their water faucet designs. For example, the Touch-Flo Company, at 59 E. Orange Grove, Burbank, Calif. 91502, and Butler Water Quality Products, of 9430 Lurline Avenue, Chatsworth, Calif. 91311, offers several models of faucets directly incorporating air gaps. One problem with the air gap designs of these companies is that they all place the brine inlet and outlet lines too close to the purified water inlet line to the water faucet, which sometimes makes installation troublesome. Another problem is their relatively high cost. A company by the name "The Foundry," of 1384 N. Nova Road, Daytona Beach, Fla. 32117, offers an air gap in the form of a generally cylindrical spacer unit upon which a water faucet with an extra long shank is mounted. However, this adapter unit raises the level of the faucet substantially up above the sink level, [over 2.54 cm (one inch), since its venting hole must by building code be at least an 2.54 cm above the level of the sink], which is unattractive to some, and requires use of a water faucet with an extra long shank.

There accordingly remains a need for an air gap adapted which can be used with standard water faucets without costly built-in air gaps and with a pure water inlet shank of normal length, and which does not substantially raise the faucet from the sink.

SUMMARY OF THE INVENTION

The present invention overcomes the above noted deficiencies of presently available air gaps by providing a new type of air gap adapters ideally suited for use with conventional water faucets without built-in air gaps.

The invention yet further provides an air gap adapter which can be use with existing water faucets without air gaps, yet does not substantially raise the level of the water faucet up above the level of a sink.

The invention also provides an air gap adapter which allows for easy installation, without crimping the brine inlet and outlet tubes.

BRIEF DESCRIPTION OF THE DRAWINGS

FIG. 2 is a perspective, exploded view showing a standard water faucet, and the various components of the air gap adapter of the invention.

FIG. 5 is a bottom view of the cap of the air gap adapter.

DESCRIPTION OF THE PREFERRED EMBODIMENT

Figure 1:
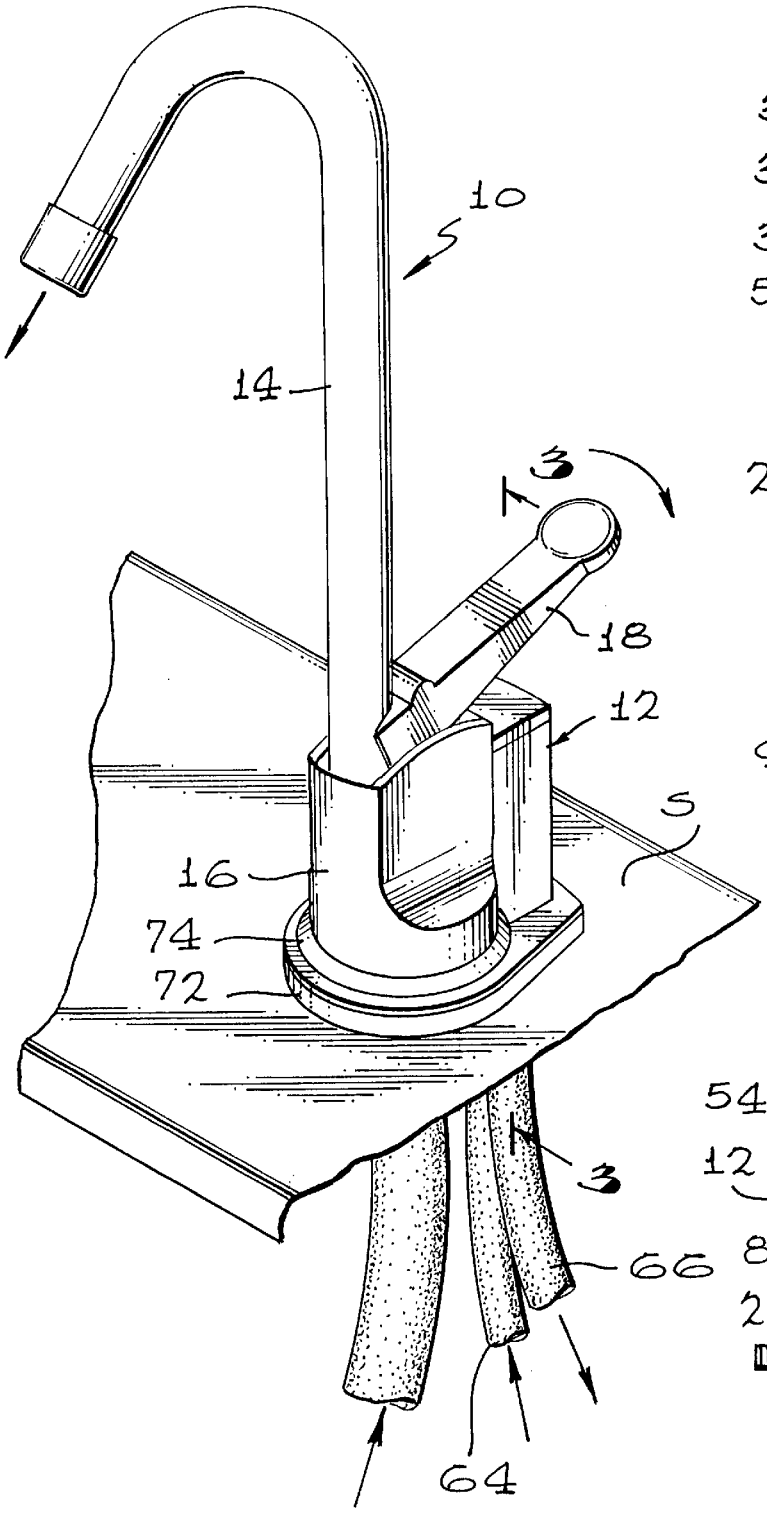
FIG. 1 is a perspective view of a conventional water faucet and the air gap adapter of the invention mounted to a sink.

Referring now more specifically to the drawings, FIG. 1 depicts a water faucet 10 used in conjunction with the air gap adapter 12, and connected to a sink top "S". Referring to FIG. 2, a perspective view of faucet, and exploded view of air gap adapter 12 of the invention are shown. The faucet 10 has a spigot 14 extending upwardly from a valve body 16, a valve lever 18 extending rearwardly from the valve body 16, and a threaded pure water inlet shank 20 extending into the valve body 16. The air gap adapter 12 has an adapter body 22 with a base portion 24 with a hole 26 formed therethrough which is sized to receive the faucet's pure water inlet shank 20. An integral riser portion 28 extends generally vertically upwardly from a rear region of the base portion 24. To maintain a low profile, the base portion 24 is preferably sized to be relatively thin, e.g. 0.6 to 0.7 cm (about one-quarter of an inch). The riser portion 28 has a brine inlet bore 30 and brine outlet bore 32 formed therethrough, the function of which will be explained further below. The brine outlet bore 32 is vertically oriented within said riser portion 28. A focusing ring 34 with a focusing hole 36 formed therethrough is inserted into the top region of the brine outlet bore 32. A cap 38 fits on an upper end 40 of the riser portion 28. The upper end 40 of the riser portion 28 has a channel region 42 formed between the brine inlet bore 30 and brine outlet bore 32.

Referring to FIG. 5, the cap 38 has two generally C-shaped bore insert portions 44 and 46, with the open ends 48 of the C-shaped protrusions 44 and 46 facing each other. The C-shaped bore protrusions 44 and 46 extend from a base surface 50 of the cap 38. The base surface 50 of the cap 38 is adapted to contact the upper end 40 of the riser portion 28, and the C-shaped bore protrusions 44 and 46 snugly fit inside the upper ends of the brine inlet and outlet bores 30 and 32.

Figure 3:
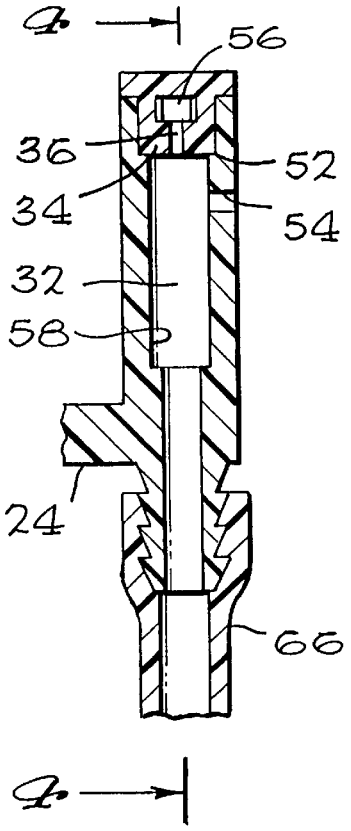
FIG. 3 is a cross-sectional view of the air gap adapter through view lines 3—3 of FIG. 1.
Figure 4:
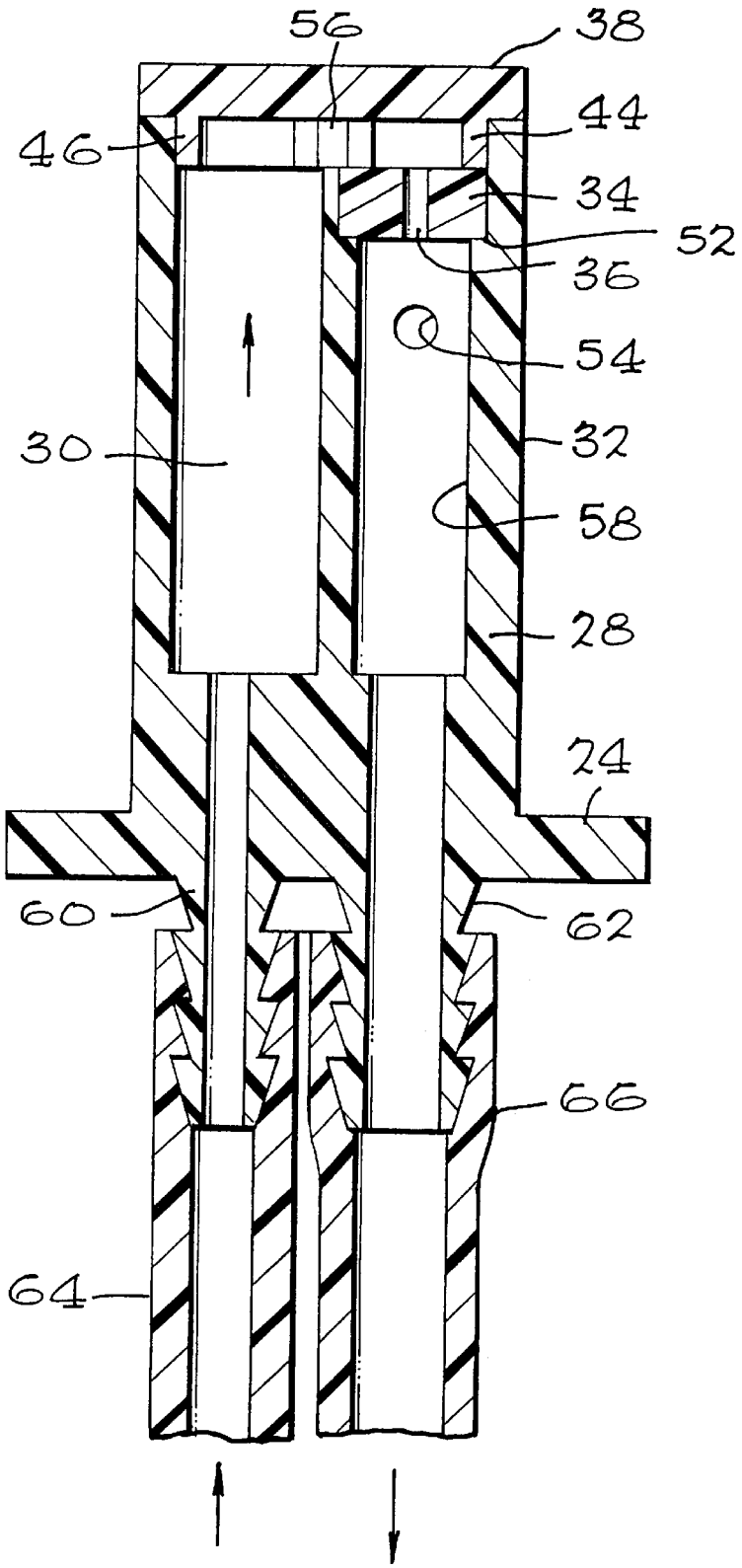
FIG. 4 is a cross-sectional view of the air gap adapted through view lines 4—4 of FIG. 3.

Best referring to FIGS. 2–4, the focusing ring 34 with focusing hole 36 is placed in a seat 52 at the top of brine inlet bore 32, and acts to direct the brine so it only to passes through the focusing hole 36. The seat 52 localizes the focusing ring 34. A venting aperture 54 is formed through the upper region of riser portion 28 and intersects the brine outlet bore 32. When the cap 38 is attached atop the riser portion 28, (i.e. with glue, sonic welding, or other means), the open ends 48 of the C-shaped protrusions 44 and 46 and the channel region 42 on the upper end 40 of the riser portion 28 between the brine inlet and outlet bores 30 and 32 will thus provide a fluid passageway 56 at the top of the riser portion 40, which allows brine to flow up the brine inlet bore 32, through the fluid passageway 56, and down through the focusing hole 36 in the focusing ring 34 and into the brine outlet bore 32. Using the focusing ring 34 with focusing hole 36 causes the brine to either flow in either a thin, steady stream, or in carefully directed drops (depending on the brine flow rate through the air gap). Because of this focused brine flow, the brine will not contact the inner sides 58 of the brine outlet bore 32 in the vicinity of the venting aperture 54 and will therefore not leak out of the venting aperture 54. While the focusing ring 34 and its focusing hole 36 are described as being a separate piece, the focusing ring 34 and focusing hole 36 can be formed integrally with the adapter body 22 if desired. In the preferred embodiment, a single venting aperture 54 is located approximately 2.5 cm above the level of the base portion 24 (for reasons of compliance with governmental regulations), but the level of the venting aperture 54 above the base portion 24 can be varied, and if desired, additional holes can be provided. Connector means, such as a barbed brine inlet fitting 60 provides fluid communication with the brine inlet bore 30 and a barbed brine outlet fitting 62 provides fluid communication with the brine outlet bore 32. These barbed fittings 60 and 62 provide for quick attachment detachment means to attach brine inlet and outlet tubes 64 and 66, respectively, such as polypropenyl tubing. The outlet fitting 62 has a larger inner and outer diameter, to accommodate a larger diameter brine tube 66, to prevent any backup of brine through the venting aperture 54. Other known fitting can be utilized to provide for secure attachment of the brine inlet and outlet tubing 64 and 66 to the device 12.

The water faucet 10 is secured together with the air gap adapter 12 to the sink S by passing the pure water inlet shank 20 of the water faucet 10 through the hole 26 in the base portion 24. As best shown in FIG. 1, the air gap adapter 12 is oriented such that its riser portion 28 lies rearwardly of the back side of the valve body 16 of the water faucet 10, and does not interfere with the operation of the valve lever 18. The riser portion 28 preferably has a concave curvature on its front wall 68 facing the valve body 16 to accommodate the cylindrical shape of the valve body 16. For water faucets 10 having other shapes, the shape of the riser portion 28 and base portion 24 can be modified accordingly. However, since many standard water faucets 10 have the shape as shown, the adapter 12 can be used with widely available water faucets 10 without built-in air gaps, and thus reduce inventory and other costs. A washer portion 70 with a shank hole 72, and tubing bracket arms 74 is placed on the end of the pure water inlet shank 20 passing through the base portion 24 and the sink S. A threaded nut 76 draws the water faucet 10 tightly down onto the base portion 24 of the air gap adapter 12. A lock washer 78 can be used to help avert loosening of the threaded nut 76 from the pure water inlet shank 20. The tubing bracket arms 74 assist in prevent the washer portion 70 from spinning as the threaded nut 76 is screwed on, and furthermore act to space the brine inlet and outlet tubes 64 and 66 from the pure water inlet shank 20.

For purposes of low cost, the main components of the air gap adapter 12 (such as the adapter body 22, the cap 38, the focusing ring (or disk) 36, the washer portion 70, and even the threaded nut, if desired) can be conveniently made of material such as injection molded plastic, and can be of any number of colors and finishes to match or complement that of the water faucet 10. Alternately, some of or all of the components can be made of stainless steel, brass, or other materials. By the barbed fittings 60 and 62 being spaced a substantial distance away from the pure water inlet shank 20 of the faucet 10, the air gap adapter 12 and the water faucet 10 can be installed and attached quite easily, without causing any crimping of the brine inlet and outlet tubes 64 and 66. As was noted above, this has been a problem with prior art water faucets with built-in air gaps. Since a majority of water faucets used with water filtration and purifaction system have very similar dimensions and sizes, the air gap adapter 12 of the invention can be used with any number of standard water faucets. As shown in FIGS. 1 and 2, the base portion 24 of the adapter body 22 preferably is wider at its lower portion 72 which contacts the sink S and has a raised stage region 74 which smoothly transitions with the water faucet's valve body 16.

Figure 6:
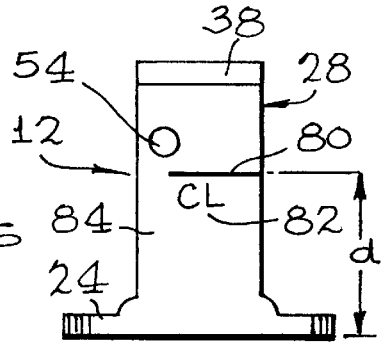
FIG. 6 is a rear view of the air gap adapter of the invention.

Referring to FIG. 6, for purposes of compliance with building codes, an indication line 80 and the letters "CL" (for "clear line") preferably appear on the rear wall 84 of the riser portion 28. The indication line 80 is located a distance d, which is a minimum of 2.54 cm (1 inch) above the bottom of the base portion 24. The venting aperture 54 is located above the indicator line 80. The indicator line 80 and the letters "CL" 82 can be directly molded into the riser portion 28.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. An air gap adapter for use with a water faucet having a pure water inlet shank, a valve body, a spigot and a valve lever, said air gap adapter comprising:

an adapter body with a base portion and an integral riser portion which extends generally vertically upwardly from at a rear region of said base portion, said base portion having an aperture formed therethrough for passage of the pure water inlet shank of the water faucet, said riser portion having a brine inlet bore and a brine outlet bore with inside walls, said brine outlet bore being generally vertically oriented in said riser portion, said brine inlet bore and said brine outlet bores being open at an upper region, two connector means located at a lower region of said adapter body and in fluid communication with said brine inlet bore and said brine outlet bore;

a venting aperture formed near an upper region of said riser portion and passing into said brine outlet bore;

a brine flow focusing means to focus flow of brine downwardly into said brine outlet bore in a directed stream so that the brine does not contact the inside side walls of the brine outlet bore, said brine flow focusing means being located in said brine outlet bore, above said venting aperture; and a cap means positioned on said riser portion at said upper region of said brine inlet bore and brine outlet bore, said cap means providing a brine flow passageway between brine flowing upwardly in said brine inlet bore, and brine flowing downwardly in said brine outlet bore; and wherein in the use of said air gap adapter, the water faucet will be placed with its pure water inlet shank through said aperture in said base portion of said adapter body so that the valve body rest on said base portion and lies in front of and adjacent said riser portion.

2. The air gap adapter of claim 1, further comprising a washer portion and a threaded nut for detachably retaining the water faucet in tight contact with said air gap adapter on a sink.

3. The air gap adapter of claim 2, wherein said washer portion has bracket arms to prevent the washer portion from spinning as said threaded nut is tightened onto the threaded pure water inlet shank.

4. The air gap adapter of claim 1, wherein said two connector means located at the lower region of said adapter body comprise barbed shanks, onto which flexible tubing is adapted to frictionally attach.

5. The air gap adapter of claim 1, wherein a front wall of said riser portion is concavely curved and is sized to accommodate the valve body of the water faucet.

6. The air gap adapter of claim 1, wherein said brine flow focusing means comprises a disk sized to fluid tightly fit into an enlarged upper end of said brine outlet bore, said disk having an aperture formed through a central line thereof, so that all of the brine flowing upwardly from the brine inlet bore will directed to flow downwardly through said focusing aperture.

7. The air gap adapter of claim 1, wherein said riser portion has a top end, with a channel region located between said upper ends of said brine inlet and outlet bores, and wherein said cap means comprises a plate with generally C-shaped bore protrusions, with open ends of the C's facing each other, which are adapted to snugly fit into the brine inlet bore and outlet bore.

8. An air gap adapter for use with a water faucet having a pure water inlet shank, a valve body, a spigot and a valve lever, said air gap adapter comprising:

an adapter body with a base portion and an integral riser portion which extends generally vertically upwardly from a rear region of said base portion, a front wall of said riser portion being concavely curved and adapted to closely fit adjacent the valve body of the water faucet, said base portion having an aperture formed therethrough for passage of the pure water inlet shank of the water faucet, said riser portion having a brine inlet bore and a brine outlet bore with inside walls, said brine outlet bore being generally vertically oriented in said riser portion, said brine inlet bore and said brine outlet bores being open at an upper region, two barbed shanks located at a lower region of said adapter body and in fluid communication with said brine inlet bore and said brine outlet bore onto which flexible tubing is adapted to frictionally attach;

a venting aperture formed near an upper region of said riser portion and passing into said brine outlet bore;

a brine flow focusing means to focus flow of brine downwardly into said brine outlet bore in a directed stream so that the brine does not contact the inside side walls of the brine outlet bore, said brine flow focusing means being located in said brine outlet bore, above said venting aperture; and a cap means positioned on said riser portion at said upper region of said brine inlet bore and brine outlet bore, said cap means providing a brine flow passageway between brine flowing upwardly in said brine inlet bore, and brine flowing downwardly in said brine outlet bore;

a washer portion with bracket arms and a threaded nut for detachably retaining the water faucet in tight contact with said air gap adapter on a sink, said bracket arms acting to prevent said washer portion from spinning as said threaded nut is tightened onto the threaded pure water inlet shank; and wherein in the use of said air gap adapter, the water faucet will be placed with its pure water inlet shank through said aperture in said base portion of said adapter body so that the valve body rest on said base portion and lies in front of and adjacent said riser portion.

9. The air gap adapter of claim 8, wherein said brine flow focusing means comprises a disk sized to fluid tightly fit into an enlarged upper end of said brine outlet bore, said disk having an aperture formed through a central line thereof, so that all of the brine flowing upwardly from the brine inlet bore will directed to flow downwardly through said focusing aperture.

10. The air gap adapter of claim 8, wherein said riser portion has a top end which said brine inlet and outlet bores reach, with a channel region located between said upper ends of said brine inlet and outlet bores, and wherein said cap means comprises a plate with generally C-shaped bore inserts, with open ends of the C's facing each other, which are adapted to snugly fit into the brine inlet and outlet bores, yet provide for fluid communication between the two bores.

* * * * *